United States Patent [19]

Arendash et al.

[11] 4,080,913

[45] Mar. 28, 1978

[54] SWING-OPEN CONVERTIBLE ARM FOR SEWING MACHINE

[75] Inventors: Joseph M. Arendash, Rocky River, Ohio; Yuji Okui, Osaka, Japan

[73] Assignee: White Sewing Machine Company, Cleveland, Ohio

[21] Appl. No.: 764,888

[22] Filed: Feb. 2, 1977

[51] Int. Cl.[2] ..... D05B 75/00

[52] U.S. Cl. ..... 112/258

[58] Field of Search ..... 112/258, 260, 217.1; 312/208, 282, 277; 108/3, 90

[56] References Cited

U.S. PATENT DOCUMENTS

| | | | |
|---|---|---|---|
| 2,958,304 | 11/1960 | Arbib | 112/260 |
| 3,344,762 | 10/1967 | Szostak et al. | 112/260 |
| 3,570,431 | 3/1971 | Fresard | 112/63 |
| 3,625,582 | 12/1971 | Naito | 312/208 |
| 3,673,972 | 6/1972 | Grange | 112/258 |
| 4,009,671 | 3/1977 | Wittler et al. | 112/258 |

*Primary Examiner*—George H. Krizmanich

*Attorney, Agent, or Firm*—McNenny, Pearne, Gordon, Gail, Dickinson & Schiller

[57] ABSTRACT

A bed in a sewing machine having a fixed free arm and auxiliary bed plate means pivotally supported on the free arm between a retracted position to provide minimum girth around the free arm and an extended position which augments the work supporting area of the free arm. Releasable locking means maintain the auxiliary bed means in either of its positions and biasing means urges the auxiliary bed means from the retracted position towards the extended position.

10 Claims, 3 Drawing Figures

SWING-OPEN CONVERTIBLE ARM FOR SEWING MACHINE

BACKGROUND OF THE INVENTION

The invention relates to improvements in sewing machines, and in particular to an auxiliary work-supporting bed for a free arm machine.

PRIOR ART

Conventional free arm or cylinder bed sewing machines have typically been provided with removable or otherwise displaceable auxiliary work-supporting surfaces. A common approach used with portable machines is the provision of one or more work-supporting panels or flaps integrated or otherwise associated with a carrying case in which the sewing machine is stored and transported. With such an arrangement, where the auxiliary panel or panels are supported by a portable carrying case, it is difficult to achieve a solid work-supporting surface free of movement relative to the bed of the machine because of the nnnecessarily light construction of such panels and a typical lack of any means interconnecting the panels directly to the free arm.

Another type of convertible free arm machine, exemplified by U.S. Pat. Nos. 3,344,762 and 3,863,582, provides an auxiliary work-supporting surface which is pivotal on a bed supported axis remote from the free arm. Since the portion of the bed providing this pivot is ordinarily an integral part of a bed, it cannot, of course, be retracted during free arm operation. As a result, the geometry and placement of such bed-supporting areas are inherently restricted and ordinarily are limited to the rear side of the machine, that is, the side opposite the operator.

SUMMARY OF THE INVENTION

The invention provides a free arm machine having auxiliary work-supporting surface means pivotally carried directly on the free arm and including means to releasably lock the auxiliary surface means in both its extended operative and retracted inoperative positions. The machine further includes means for resiliently biasing the auxiliary surface means towards the operative position to provide convenience for the operator in changing the mode of sewing from free arm to flat bed operation and to maintain the auxiliary surface means tensioned against vibration, rattling, and visually distracting movement.

The disclosed auxiliary support surface means, as a result of being carried directly on the free arm, is readily converted between free arm and flat bed configurations without complicated or tedious manipulation. Release means in the form of a rotary knob is provided to quickly unlatch the auxiliary surface means from the retracted free arm position. Upon its release, the auxiliary surface means pivots upwardly into the plane of the working surface of the free arm. Since the auxiliary work-supporting surface is permanently attached to the fixed free arm, it is always at hand, in full alignment, and rigidly supported. Additionally, the arrangement of the auxiliary supporting surface means on the free arm is particularly adapted to be employed at the front, as well as the rear, side of the free arm, since its retracted configuration does not obstruct free access to the general area surrounding the free arm.

DESCRIPTION OF THE PREFERRED EMBODIMENT

A fixed free arm bed 1 comprises a main arm bed body *a* in the shape of a conduit or channel with an open upper face and an arm bed top plate *b* which is fixed to the upper face of the body. An auxiliary bed 2 of a type which opens on the front and back of the free arm 1 comprises a front auxiliary bed section 2*a* which opens or closes on the operator's side, i.e., with reference to FIG. 1 this side of the sewing machine and an auxiliary bed section 2*b* which opens or closes on the rear or other side of the machine. Each of the respective upper edge portions of the front and rear auxiliary bed sections 2*a* and 2*b* is installed on the arm bed 1 by respective hinge elements 3 for pivotal or swinging movement along the longitudinal direction of the arm bed.

Figure 1:
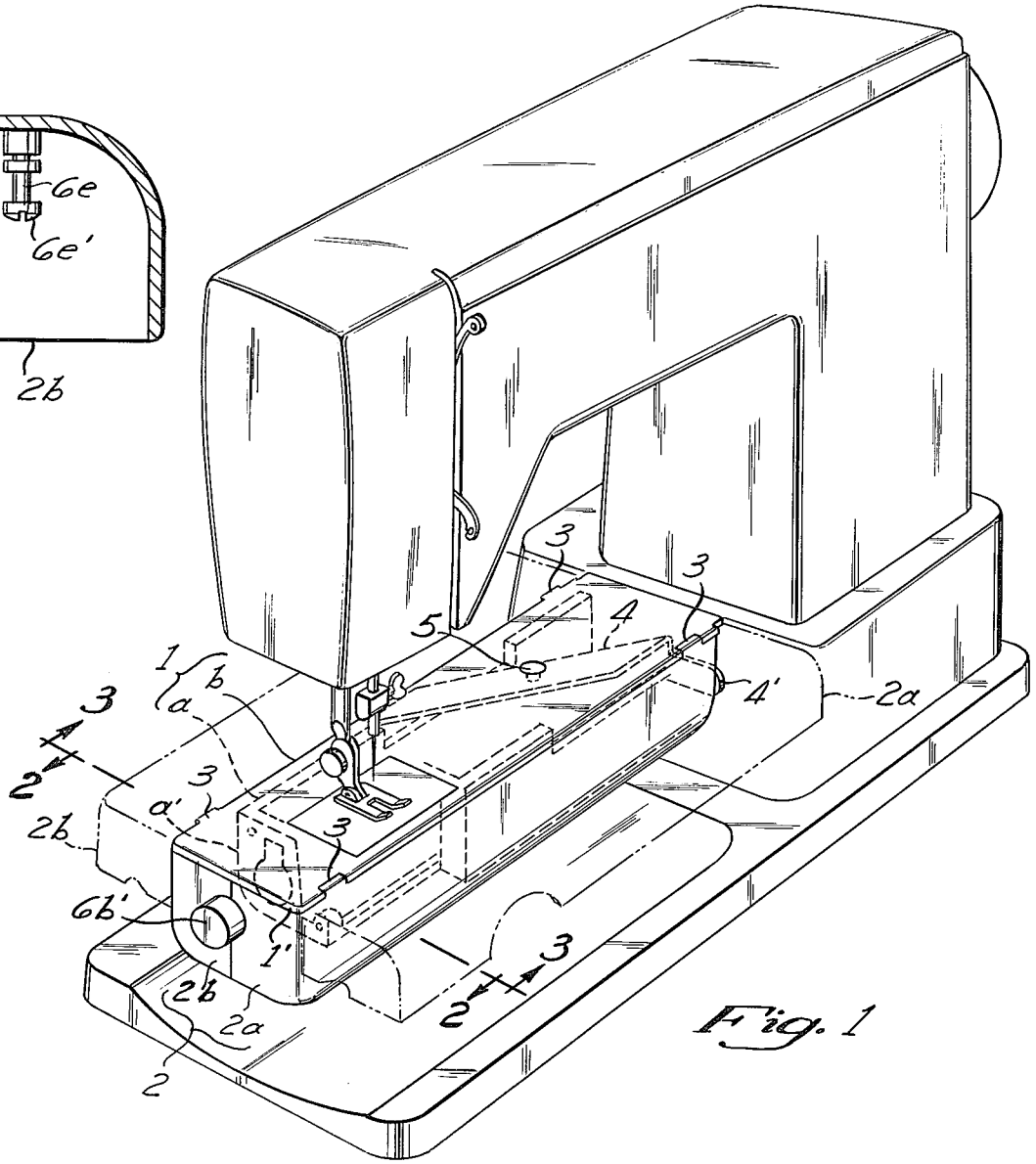
FIG. 1 is an oblique view of a sewing machine in which an auxiliary bed constructed in accordance with the invention is installed.

An auxiliary bed support and release lever 4 is pivoted by means of a pin 5 in such a manner as to be freely rotatable in a horizontal direction or plane on the reverse or underside of the aforementioned arm bed top plate *b*, and includes an operating handle 4'. This support lever 4 is disposed in a gap between the main arm bed body *a* and the top plate *b*. At the time when the auxiliary bed 2 is in a closed or retracted state, the tip of the handle 4' is slightly extended from the right hand terminal face of the auxiliary bed 2*a* on this front side, as shown in FIG. 1, such that the support lever 4 is disposed obliquely on the upper face of the main bed body *a*. At the time when the auxiliary beds 2*a* and 2*b* are opened, as shown by dotted line in the same figure, the handle 4' is positioned at the front on this side, with the result that it protrudes in its modified state in a direction which crosses, i.e., extends generally perpendicular to the main body *a* and has a length which is sufficiently longer than the width of the main body *a* so as to support the auxiliary beds 2*a* and 2*b* from their lower surfaces.

Figure 2:
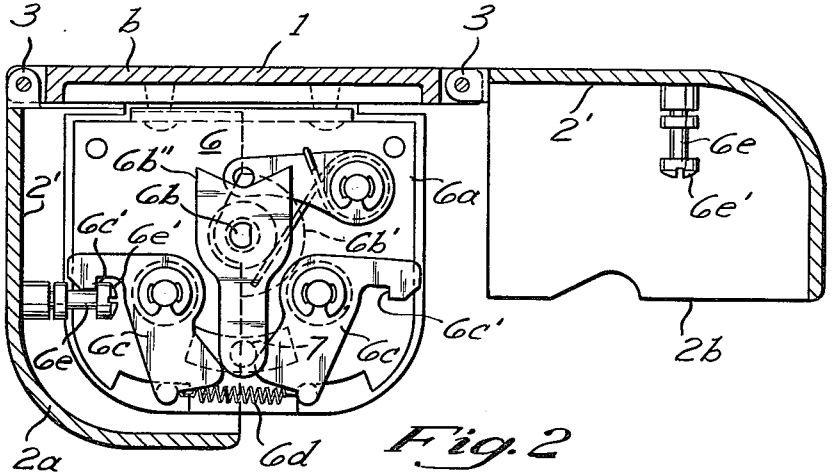
FIG. 2 is an elevational view of the locking mechanism which appears on the left sectional cut along line 2—2 in FIG. 1.
Figure 3:
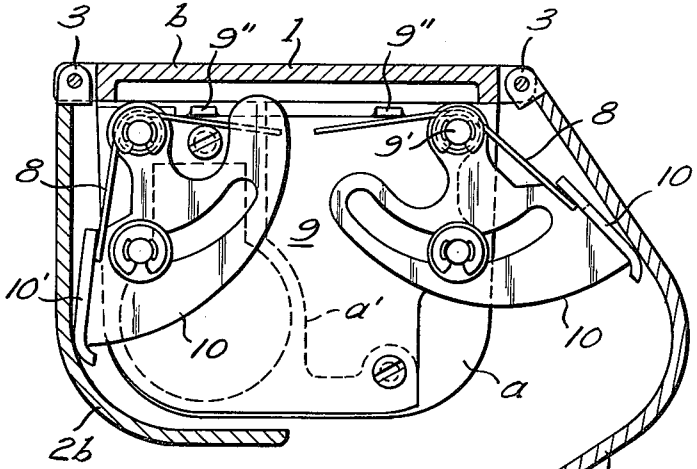
FIG. 3 is an elevational view which appears on the cross section cut along line 3—3 in FIG. 1, illustrating auxiliary release spring means.

A latch 6 for the auxiliary bed 2 is provided at the tip or unsupported end 1' of the free arm 1. This latch 6 consists, as shown in FIG. 2, of a base plate 6*a* which is secured to the reverse side of the top plate *b*, and a freely rotatable operating shaft 6*b* which has a handle or knob 6*b'* at the outer end, which runs through the base plate 6 and which has a plate 6*b''* in the shape of an arrow fixed adjacent its inner end. The latch 6 further includes a pair of hook pieces 6*c* each in the shape of a bell crank, which are symmetrically pivoted on the base plate 6*a* in such a manner that their respective inner terminals may contact a pin 7 which protrudes at the lower end of the aforementioned arrow-shaped plate 6*b''* and a spring 6*d* which is provided between the aforementioned pair of hook pieces 6*c* in such a manner as to mutually pull the lower ends of the hook pieces 6*c* towards one another. Engaging elements 6*e* are provided on the reverse side 2' of the auxiliary beds on this side 2*a* and the other side 2*b* in such a manner that the respective expanded head parts 6e' may each be engaged with a hook 6c' which is formed at the outer edge of an aforementioned hook piece 6c, respectively.

Each hook piece 6c is made to rotate in conformity with the pin 7, whose position is changed by manually rotating the operating shaft 6b through the knob 6b', either to the right or to the left, in opposition to the spring 6d, such that the engagement of the engaging element 6e is released and, for example, the locked state on the left hand side of FIG. 2 can be changed to the open state as on the right hand side. In addition, the engaging element 6e rotates the hook piece 6c by the head part 6e' and becomes engaged with the hook piece 6c' in response to displacement or pushing of the auxiliary bed 2 from the released state to the closed state.

A pair of auxiliary release springs 8 of the auxiliary bed 2 are provided inside the tip 1' of the arm bed along with the aforementioned latch 6. The auxiliary springs 8 are each supported by a pin 9' provided at the right and left of the top of a base plate 9 which is installed to cover the end surface *a'* of the main arm body *a*. One end of each spring 8 engages a bent portion 9'' at the upper edge of the base plate 9 and the other end engages the outer edge or shoe 10' of an oscillating plate 10 having the shape of a fan with its base portion being freely installed or pivoted on the aforementioned pin 9'.

The auxiliary bed 2 is thereby biased in the open or releasing direction at all times via the said oscillating plates 10. Since the auxiliary bed 2 is urged towards the open position when it is closed, the closed or locked state is maintained in a more stable manner and, at the time of release, the auxiliary bed 2 is automatically half-opened in such a manner as to facilitate the raising of the same. According to the embodiment whose structure and functions are described above, it is possible to maintain the open and closed state of the auxiliary bed in a stable state at the desired position by action of the release support lever 4, the latch 6, and the auxiliary release spring means 8. In addition, the operation involved is simple, with a consequence that the use of a free arm sewing machine is made easier.

While the invention has been described in connection with specific embodiments thereof, it is to be clearly understood that this is done only by way of example, and not as a limitation to the scope of the invention as set forth in the objects thereof and in the appended claims.

What is claimed is:

1. A sewing machine having a free arm comprising a fixed bed having an upper surface, at least one auxiliary bed extending longitudinally along one side of the fixed bed, said auxiliary bed having a length substantially equal to the length of the fixed bed, means on said fixed bed for pivotally supporting said auxiliary bed for rotation about a longitudinal axis between a work-supporting position coplanar with said upper surface and a retracted position defining a vertical side of said free arm first releasable locking means for maintaining said auxiliary bed in said work-supporting position, second releasable locking means for positively maintaining said auxiliary bed in said retracted position, and manually engageable means for releasing said second locking means.

2. A sewing machine as set forth in claim 1, wherein said fixed bed includes an end face at the free end thereof, said manual releasing means being disposed on said end face.

3. A sewing machine as set forth in claim 1, wherein said auxiliary bed is L-shaped in transverse cross section, said auxiliary bed being arranged to extend vertically closely adjacent a side of said fixed bed and horizontally beneath said fixed bed when said auxiliary bed is in its retracted position.

4. A sewing machine as set forth in claim 1, wherein said second locking means includes a spring-biased hook element carried on one of said beds, the other of said beds having an element fixed thereon for engagement with said hook when said auxiliary bed is in said retracted position, said manual releasing means being arranged to move said hook in opposition to the spring biasing force out of engagement with said engagement element.

5. A sewing machine as set forth in claim 1, including means for resiliently biasing said auxiliary bed from said retracted position toward said work-supporting position.

6. A sewing machine having a free arm comprising a fixed bed having an upper surface and at least one auxiliary bed extending longitudinally along one side of the fixed bed, said auxiliary bed having a length substantially equal to the length of the fixed bed, means on said fixed bed for pivotally supporting said auxiliary bed for rotation about a longitudinal axis adjacent said upper surface between a work-supporting position coplanar with said upper surface and a retracted position defining a vertical side of said free arm, and means for locking said auxiliary bed in said work-supporting position, said locking means including a member manually movable in a horizontal plane and adapted to support said auxiliary bed in said work-supporting position by transverse vertical loading thereof in the manner of a cantilever.

7. A sewing machine as set forth in claim 6, wherein said movable member in its auxiliary bed-supporting position is disposed generally at a point midway along the length of said beds.

8. A sewing machine as set forth in claim 7, wherein said movable member is movably mounted on said fixed bed.

9. A sewing machine as set forth in claim 8, wherein said movable member is a lever pivotal about a vertical pin between a closed position wherein said lever is substantially within said fixed bed and an open position wherein a portion of said lever extends laterally from said fixed bed in the manner of a cantilever.

10. A sewing machine having a free arm comprising a fixed bed having an upper surface and a pair of cooperating auxiliary beds extending longitudinally along the fixed bed, one along the front side thereof and the other along the rear side thereof, said auxiliary beds having a length substantially equal to the length of the fixed bed, said auxiliary beds each having an L-shaped configuration in transverse cross section, means on said fixed bed adjacent a work-supporting surface area thereof for pivotally supporting said auxiliary beds for rotation about respective longitudinal axes, said auxiliary beds being pivotal about said axes between work-supporting positions coplanar with said upper surface and retracted positions defining the front, rear, and lower sides of the fixed bed, means for resiliently biasing said auxiliary beds from their retracted positions to their work supporting positions, first locking means to releasably maintain said auxiliary beds in their retracted positions, second locking means to maintain said auxiliary beds in their work-supporting positions and manually engageable means supported on said fixed bed independently of said auxiliary beds for releasing said first locking means.

* * * * *